United States Patent [19]

Stewart

[11] 4,066,261

[45] Jan. 3, 1978

[54] MULTI-LAYERED ARCHERY TARGET

[76] Inventor: Marvin L. Stewart, 113 Elbring Drive, St. Louis, Mo. 63135

[21] Appl. No.: 691,547

[22] Filed: June 1, 1976

[51] Int. Cl.[2] ..... F41J 3/00

[52] U.S. Cl. ..... 273/102 B; 273/DIG. 2; 273/DIG. 4

[58] Field of Search ..... 273/102 R, 102 B, 102 S, 273/102.4, DIG. 2, DIG. 4, DIG. 8

[56] References Cited

U.S. PATENT DOCUMENTS

| | | | |
|---|---|---|---|
| 3,048,401 | 8/1962 | Dishon | 273/102 R |
| 3,088,738 | 5/1963 | Meyer | 273/102 B X |
| 3,109,618 | 11/1963 | Saunders | 273/102 B X |
| 3,164,384 | 1/1965 | Stewart | 273/102.4 |
| 3,476,390 | 11/1969 | Roloff et al. | 273/102.4 X |
| 3,762,709 | 10/1973 | Roloff et al. | 273/102 B |

FOREIGN PATENT DOCUMENTS

| | | | |
|---|---|---|---|
| 1,022,343 | 3/1966 | United Kingdom | 273/102 B |

OTHER PUBLICATIONS

The Sporting Goods Dealer, "Archery Mat made of Rubberized Hair," May, 1963, p. 197.

*Primary Examiner*—Richard C. Pinkham
*Assistant Examiner*—Vance Y. Hum
*Attorney, Agent, or Firm*—Glenn K. Robbins

[57] ABSTRACT

A multi-layered archery target of lightweight and self-closing of arrow holes characteristic. The target is made of three layers comprising a front layer of expanded polyethylene, a middle layer of relatively lightweight expanded polystyrene, and a rear layer of expanded polyethylene. The two layers of polyethylene are denser than the expanded polystyrene and have the characteristic of self-closing or healing of holes created by high speed arrows. The expanded polystyrene layer which may be thicker than the expanded polyethylene layers is of lighter weight and adds bulk as well as arrow stopping characteristics. The multi-layered target is of considerably lighter weight than conventional targets and through the self-closing and healing of target holes resists destruction for a much longer period of time.

2 Claims, 3 Drawing Figures

MULTI-LAYERED ARCHERY TARGET

SUMMARY OF THE INVENTION

In the past various types of archery targets have been devised. Such targets made conventionally of straw and a canvas cover are easily punctured, particularly by high speed arrows from the more powerful present day bows providing from as high as 60 to 100 pounds of pull. These arrows puncture a target and in some cases will fly completely through causing great danger to the area in the rear of the target. Further it has been a problem to prevent early destruction of the target provided by or occasioned by the high speed arrows and the cost of replacement on a repeated basis is quite considerable. Additionally the chewing up or destruction caused by the holes created by the impact of the arrow on the target can obliterate the markings on a target and cause premature destruction necessitating costly replacement.

By means of the instant invention there has been provided a lightweight multi-layered target capable of stopping the present day high speed arrows and prolonging greatly the life of the target. The target is comprised of a first layer of expanded polyethylene, such as 6 pound density, which has the natural characteristic of self closing or self healing of holes caused by the arrow striking the target. A second layer of expanded polystyrene, such as 2 pound density, which is considerably lighter and of a thicker cross section, is provided in the middle of the target. This layer provides bulk and also mass and aids in slowing down the velocity of the arrow. The last layer or the rear layer, is composed of a layer of expanded polyethylene similar to the front layer such as 6 pound density. This last layer may be conventionally of the same thickness as the front layer.

A tapered replaceable plug of the same composition as the remainder of the target comprising the multi-layered structure is provided in the central part of the target. This is the area of heaviest impact. Thus when the central plug is ultimately damaged by a large number of arrows passing through it, it can be simply removed and replaced.

The multi-layered target of this invention is of quite lightweight in the order of 2½ pounds compared to a considerably higher weight of conventionally targets. This lightweight considerably facilitates the set up and removal of the target and its transport from one area to another. The increased life of the target made possible through the structure of this invention further adds to the enjoyment of the user and over a long period has the advantage of economy of money and time in minimizing replacement.

The above features are objects of this invention and further objects will appear in the detailed description which follows and will be otherwise apparent to those skilled in the art.

For the purpose of illustration of this invention there is shown in the accompanying drawings a prefered embodiment thereof. It is to be understood that these drawings are for the purpose of example only and that the invention is not limited thereto.

Figure 3:
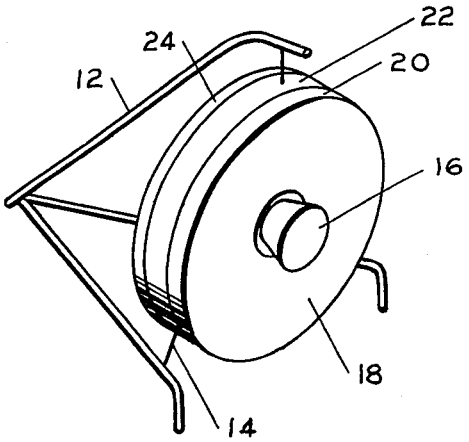
FIG. 3, is a pictorial view of the target attached to a triangular stand with the central plug partially removed.

DESCRIPTION OF THE INVENTION:

The target of this invention is generally indicated by the reference numeral 10. It is shown attached to a triangular stand 12 in FIG. 3, and supported by springs 14.

Figure 1:
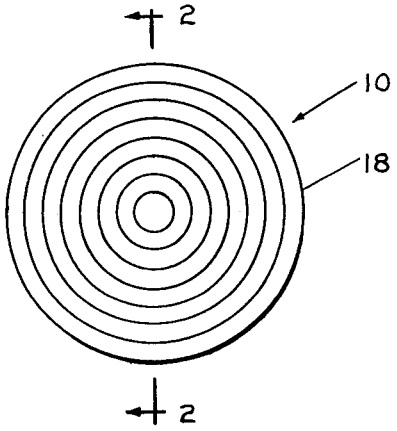
FIG. 1, is a view in front elevation of the target.
Figure 2:
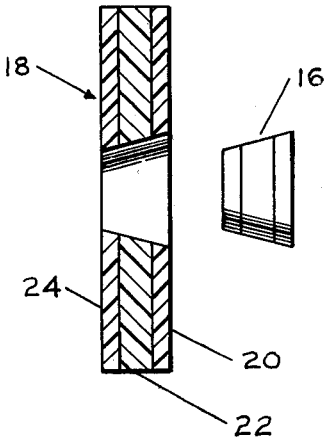
FIG. 2, is an enlarged view in section taken on the line 2—2 showing the central plug removed.

The particular structure of the target is best shown in FIG. 2 where the target is comprised of the plug 16 and the main body 18.

The target is comprised of a first layer 20 of expanded polyethylene, a middle layer of expanded polystyrene, as indicated at 22, and a third and rear layer 24 comprised of expanded polyethylene. The front and rear layers are of lesser thickness than the middle layer being approximately one half the thickness of the layer of expanded polystyrene.

The front and rear layers of expanded polyethylene are desirably made of 6 pound density per cubic foot of expanded polyethylene such as the Ethafoam manufactured by the Dow Chemical Company. This is a tough, flexible and resilient closed cell foam material which can be cut, shaped or molded into the desired configuration. The Ethafoam although being light in weight has considerably more mass as compared to the expanded polystyrene and has in particular a self closing or self healing of puncture holes created by the passage therethrough or into it of arrows. As an example the front and rear layers of expanded polyethylene has a 26 inch diameter and a thickness of 1¼ inch.

The expanded polystyrene is desirably constructed of a two pound density material such as Styrofoam brand of expanded polystyrene manufactured by Dow Chemical Company. This material is an extruded multi-cellular polystyrene foam obtainable in solid semi-rigid billets, boards and other commercial shapes. This intermediate layer has likewise a diameter of 26 inches but a thickness of about 2¼ inches representing almost twice the thickness of the front and rear layers of expanded polyethylene.

The complete target weighs about 2½ pounds compared with a considerably higher weight of conventional targets. The stopping qualities in impeding passage of the arrow are also greatly improved and it is found that a back pad is not needed. The replaceable plug 16, being of a tapered construction, can be simply press fitted in the cavity in the body 18 of the target and replaced as needed.

The target 10 is simply supported on the stand 12 by conventional means not shown. Thus the springs 14 can be connected to screw eyes imbedded in the body 18 of the target or a rim to enclose the target can be connected to the spring 14 in conventional and obvious fashion which forms no part of this invention.

In use the target is simply used as a conventional target with the stand 12. The arrows directed at the target pass first through the front layer 20 which with its considerable mass will provide the major stopping characteristic of the target. The target may be further pierced by the arrow with the arrow passing through the central and thicker portion 22. The expanded polystyrene will tend to be broken up with repeated passage of arrows therethrough but its mass will provide a considerable stopping effect. The last layer 24 of the expanded polyethylene provides the last barrier to stop the arrow. Lower speed arrows will be stopped by the first and second layers while the third layer acts to stop the highest speed arrows.

Various changes and modifications may be made within this invention as will readily apparent to those skilled in the art. Such changes and modifications are within the scope and teaching of this invention as defined by the claims appended hereto.

What is claimed is:

1. An archery target having relatively lightweight and self-closing of arrow hole characteristics, said target being comprised of three separate layers constituting a first front layer of expanded polyethylene, said first layer having a substantial thickness and mass to provide a major arrow stopping characteristic, a second intermediate layer of relatively lightweight expanded polystyrene and a third rear layer of expanded polyethylene of substantial thickness, said expanded polyethylene having the capacity to close arrow holes therethrough, the intermediate layer of expanded polystyrene being substantially thicker and lighter than either of the layers of expanded polyethylene, the layers of expanded polyethylene having a thickness of about one inch and a density of about 6 pound per cubic foot and the layer of expanded polystyrene having a thickness of about two inches and a density of about 2 pounds per cubic foot.

2. The archery target of claim 1, in which the target has a replaceable central plug of the aforementioned three layer target composition, said plug having a frusto-conical configuration tapering from a greater diameter in the first layer to a smallest diameter in the third layer and being insertable into the target from said first layer, said first layer forming the front of the target.

* * * * *